US008359774B2

(12) United States Patent
Trowsdale et al.

(10) Patent No.: US 8,359,774 B2
(45) Date of Patent: Jan. 29, 2013

(54) IRONING BOARD

(75) Inventors: Dan Trowsdale, Leeds (GB); Paul Wigzell, Cornwall (GB); John Cocksedge, Leeds (GB)

(73) Assignee: Vale Mill (Rochdale) Limited, Rochdale, Lancashire (GB)

( * ) Notice: Subject to any disclaimer, the term of this patent is extended or adjusted under 35 U.S.C. 154(b) by 329 days.

(21) Appl. No.: 12/728,785

(22) Filed: Mar. 22, 2010

(65) Prior Publication Data

US 2010/0242317 A1 Sep. 30, 2010

(30) Foreign Application Priority Data

Mar. 20, 2009 (GB) ..... 0904841.4

(51) Int. Cl.
*D06F 81/08* (2006.01)
*D06F 81/00* (2006.01)

(52) U.S. Cl. ..... 38/137

(58) Field of Classification Search ..... 38/103–140
See application file for complete search history.

(56) References Cited

U.S. PATENT DOCUMENTS

| | | | | |
|---|---|---|---|---|
| 2,495,468 | A * | 1/1950 | Mueller | 38/104 |
| 2,645,046 | A * | 7/1953 | Frej | 38/137 |
| 3,430,370 | A * | 3/1969 | Topliffe | 38/104 |
| 3,568,900 | A * | 3/1971 | Paris | 223/70 |
| 4,166,331 | A * | 9/1979 | Wallace | 38/15 |
| 5,315,773 | A * | 5/1994 | Iwami et al. | 38/77.6 |
| 6,550,164 | B2 * | 4/2003 | Rosa | 38/137 |
| 7,210,254 | B2 * | 5/2007 | Docker | 38/104 |
| 7,886,944 | B2 * | 2/2011 | Damrath et al. | 223/70 |
| 2002/0121032 | A1 * | 9/2002 | Loger et al. | 38/103 |

FOREIGN PATENT DOCUMENTS

| | | | |
|---|---|---|---|
| CN | 2606754 | Y | 3/2004 |
| EP | 0587472 | A1 | 3/1994 |
| EP | 1505196 | A1 | 2/2005 |
| GB | 2226830 | A | 7/1990 |
| JP | 2241500 | A | 9/1990 |
| KR | 20090015191 | A | 2/2009 |

* cited by examiner

*Primary Examiner* — Ismael Izaguirre
(74) *Attorney, Agent, or Firm* — Barlow, Josephs & Holmes, Ltd.

(57) ABSTRACT

An ironing board 1 having a permeable ironing surface 5 mounted on a body 3. The body 3 has one or more ports 54 through which fluid may be driven to cause the fluid to flow through the permeable surface 5. The body 3 also has a means for modifying the flow of fluid through selected regions of the surface 5. The means for modifying the flow of fluid may be one or more fans which are capable of sucking fluid from the body interior or blowing fluid into the body interior. The permeable surface may be a steel mesh surface with holes of different cross-sectional area.

16 Claims, 15 Drawing Sheets

IRONING BOARD

The present invention relates to an ironing board.

An increasingly common type of ironing board, often referred to as a vacuum board, uses suction to draw steam and air through the ironing surface. This suction tends to be provided by a fan which has the effect of holding the item to be ironed in place on the ironing surface and drawing steam from a steam iron through the item, effectively ironing both sides of the item at once. This greatly reduces ironing time and improves the ironing finish.

Low cost, domestic versions are known but are typically limited by cost, noise and power constraints. Such boards are therefore limited to a small number of low capacity fans which have lower airflow rates than those of more powerful commercial vacuum boards. Domestic versions therefore suffer from uneven airflow rates across the surface of the board. The airflow rate tends to be greatest at the region of the surface adjacent the fan which is usually mounted at the widest end of the board, least used for ironing. Conversely, the area of the board that is remote from the fan, which is typically most frequently used for ironing, tends to suffer from reduced airflow rates. The airflow rate at this region of the board can therefore be unsatisfactory.

An object of embodiments of the invention is to mitigate these difficulties.

According to a first aspect of the present invention, there is provided an ironing board comprising a permeable ironing surface mounted on a body, the body comprising one or more ports through which fluid may be driven to cause the fluid to flow through the permeable surface, wherein the body comprises a means for modifying the flow of fluid through selected regions of the surface.

The means for modifying the flow of fluid enables the proportion of fluid flowing through more heavily used regions of the board to be increased, enabling improved performance to be obtained with a relatively low overall rate of fluid flow.

According to a second aspect of the present invention, there is provided an ironing board comprising a permeable ironing surface, wherein the permeable surface is configured to permit increased fluid flow through selected regions of the surface.

An ironing board according to the first or second aspect of the present invention can be arranged so that fluid preferentially flows through specific regions of the permeable ironing surface by a suction or blowing means. Therefore, regions of the surface remote from the suction or blowing means, which may be used more frequently for ironing than regions closer to the suction or blowing means, can be arranged to have a higher fluid flow rate than conventional vacuum ironing boards.

The permeable surface may comprise holes, wherein specific regions of the surface have holes of a larger cross-sectional area than other regions of the surface.

Preferably, the body and the permeable ironing surface together define a hollow chamber beneath the permeable surface. Preferably, the means for modifying the fluid flow rate through the permeable surface comprises one or more walls dividing the hollow chamber into two or more regions. Preferably, the walls of each region restrict fluid flow from one region to another.

The ironing board may further comprise one or more means for driving fluid through one or more ports. Preferably, the or each driving means is a fan. The fan may be connected to the body of the ironing board.

The body preferably has an open region and the permeable surface is preferably shaped and configured to cover the opening. Preferably, the permeable surface is detachable from the body.

In a preferred embodiment there are two walls dividing the body into three regions, one of the regions separating the other two along the centre of the body to form a central region and two side regions. Preferably, the central region has a larger cross-sectional area than either side region.

Preferably the central region comprises two sections, one of the sections having a larger cross-sectional area than the other. Preferably, the larger section is further from the or each driving means than the smaller section. Preferably, the larger section and the smaller section are arranged relative to the driving means such that the smaller section is between the driving means and the larger section. The body may be tapered at an end and the larger section of the central region may be arranged to be adjacent the tapered end of the permeable surface.

The regions preferably define a fluid flow path from the permeable surface to the or each port. Preferably, the cross-sectional area of the fluid flow path of each region is reduced toward the or each port. More preferably, the cross-sectional area of the fluid flow path of the central region toward the or each port is greater than that of either side region.

The ironing board may further comprise an iron rest which extends from an end of the body and which can be moved from a first position to a second position, wherein the second position is further from the body than the first position.

The body may comprise one or more locking means arranged to retain the permeable surface to the body. The or each locking means may comprise a cam which can be arranged relative to the permeable surface to retain the permeable surface relative to the body. Preferably, the permeable surface comprises a U-shaped groove arranged to receive an edge of the cam, wherein the cam, and hence, the permeable surface can be retained relative to the body.

In place of a fan, the driving means could comprise a vacuum pump.

In order that the invention may be more clearly understood, an embodiment therefore will now be described, by way of example, with reference to the accompanying drawings, in which.

Figure 1:
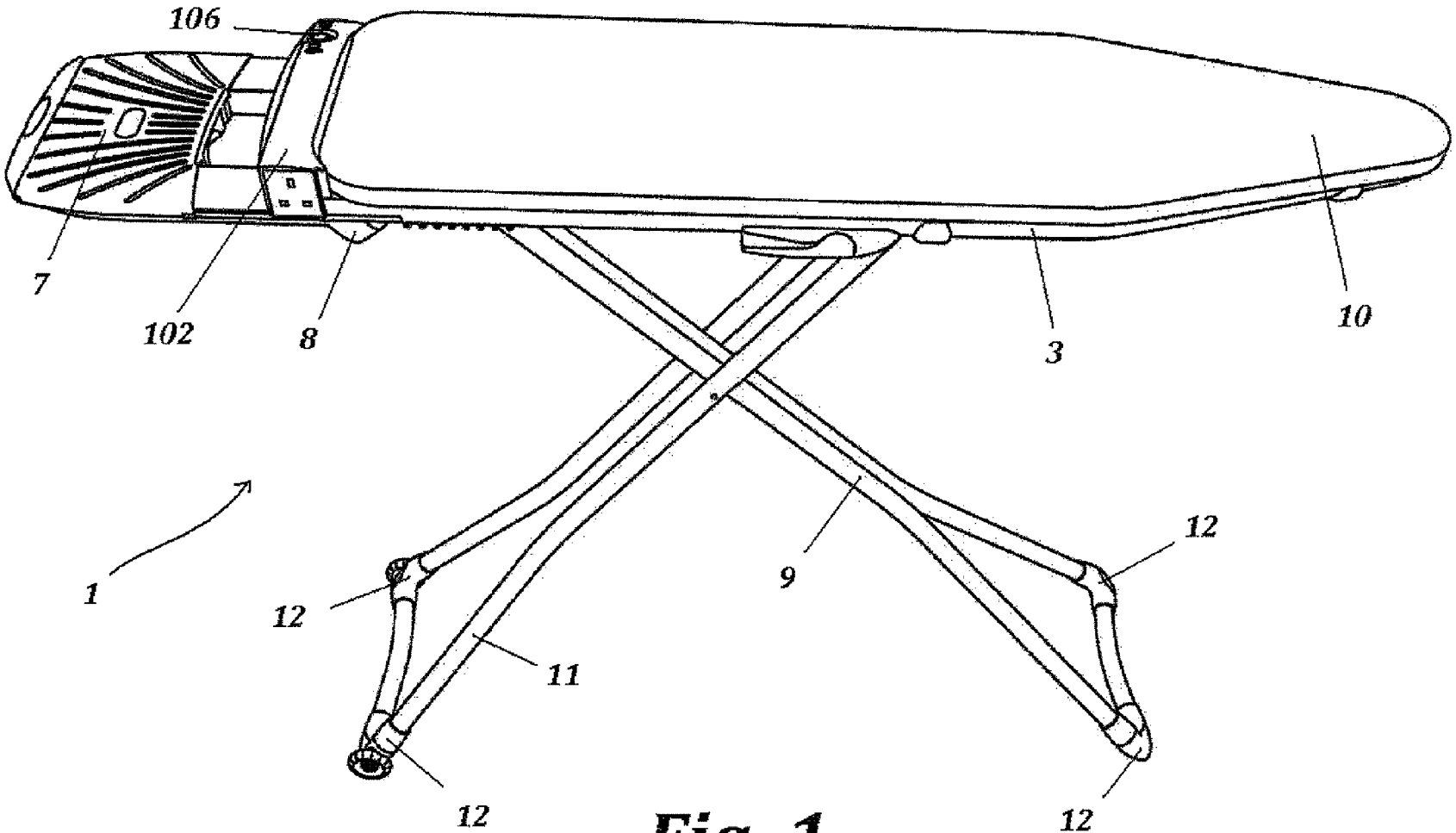
FIG. 1 is a perspective view of an ironing board according to the present invention.
Figure 13A:
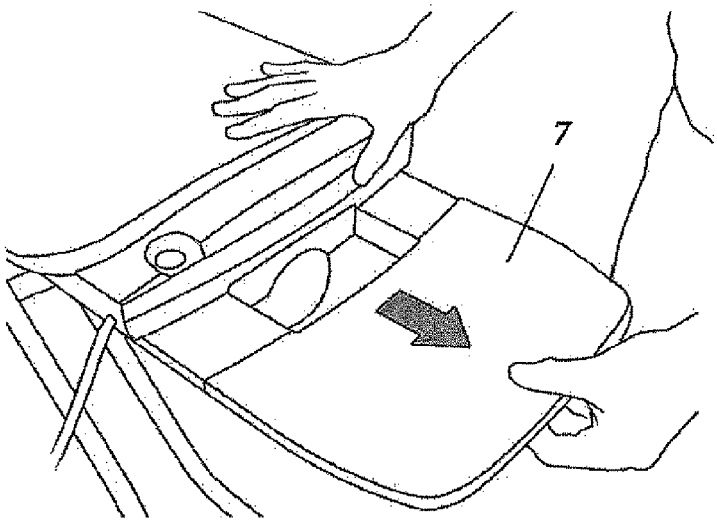
Figure 13B:
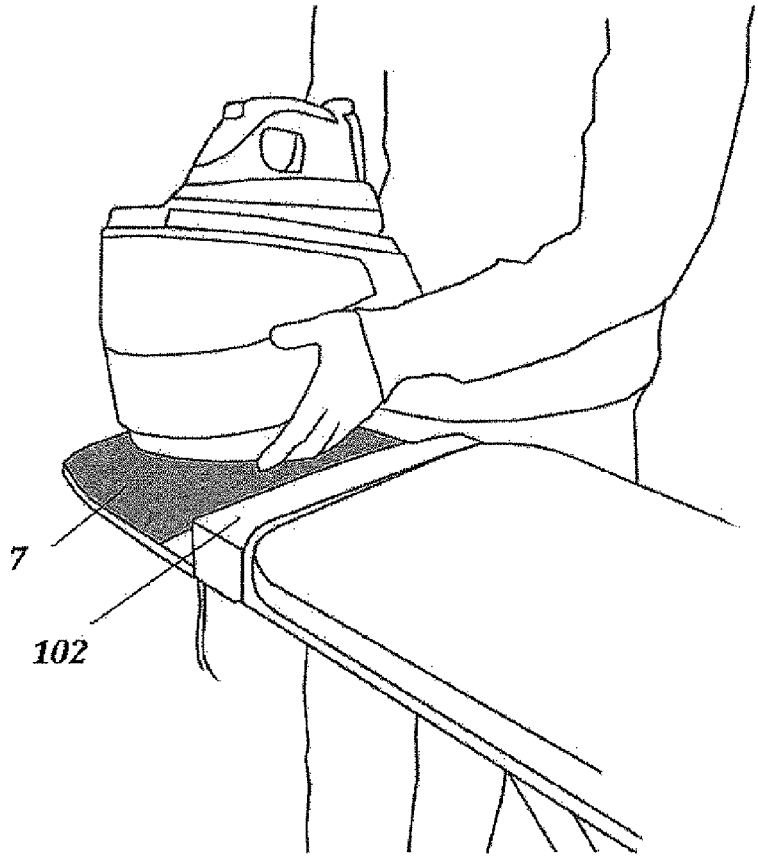
Figure 14:
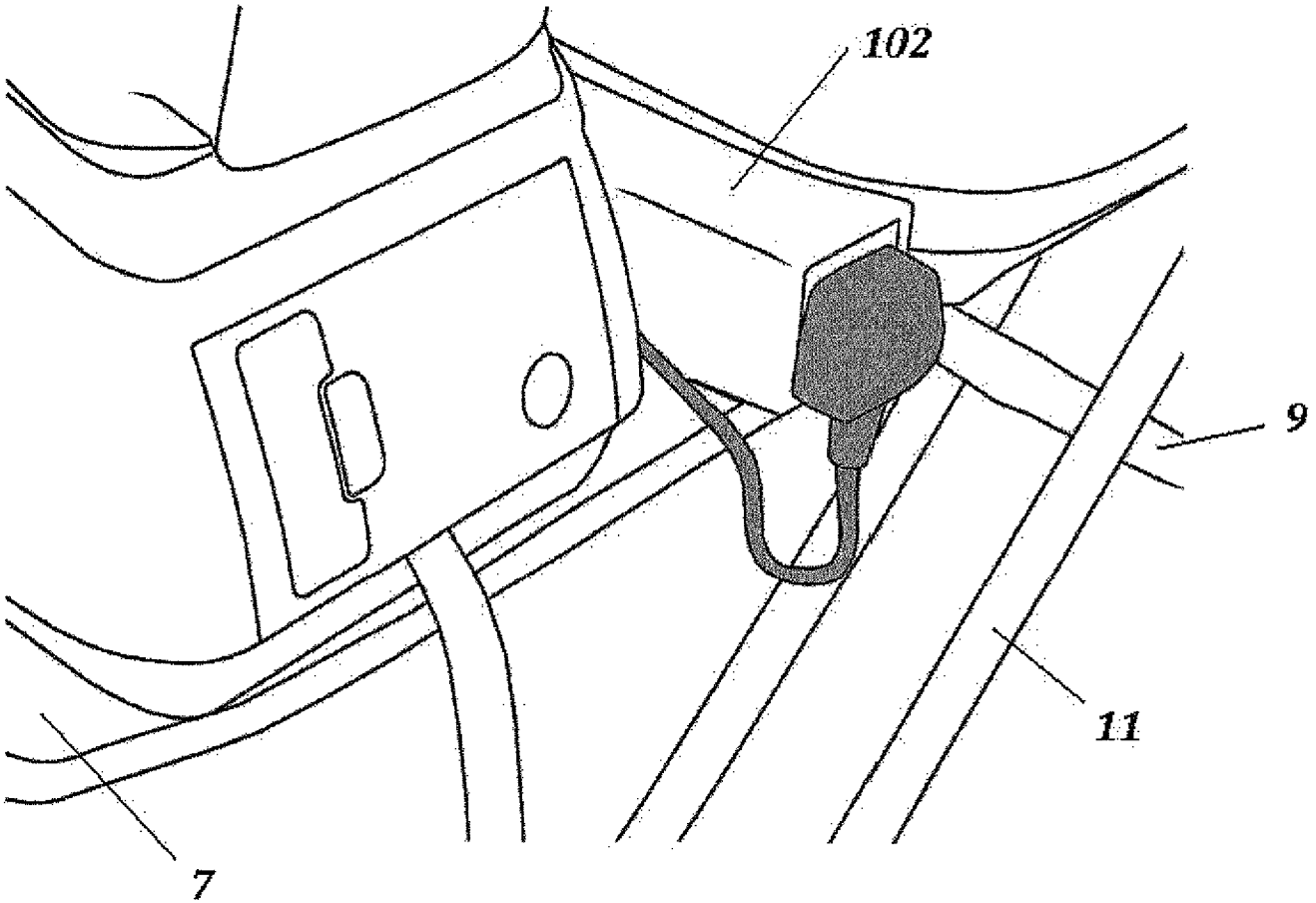
Figure 15:
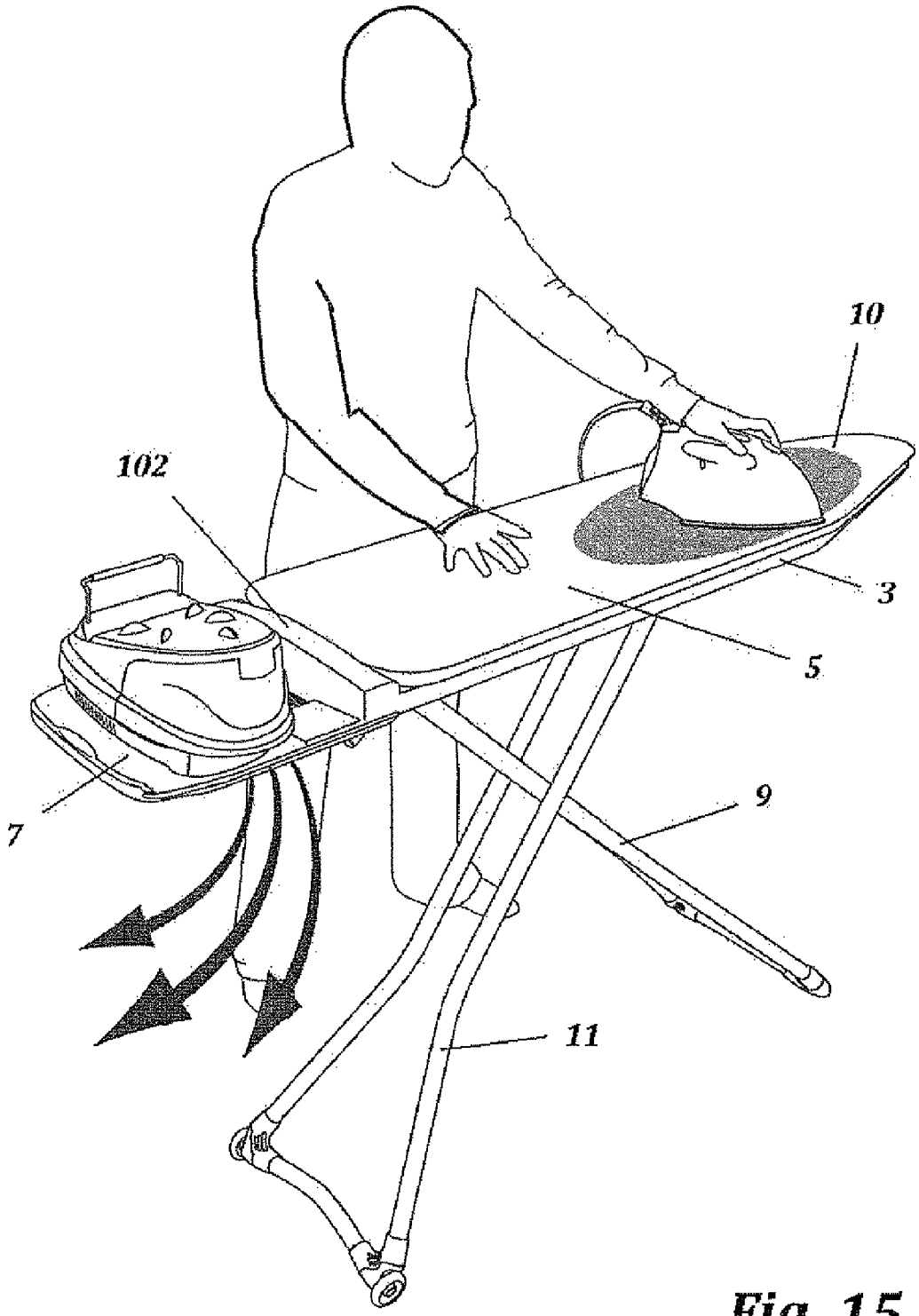

FIGS. 13*a* and 13*b* are alternative perspective views of the iron rest of the ironing board shown in FIG. 1;

FIG. 14 is an enlarged perspective view of the iron rest area of the ironing board shown in FIG. 1; and FIG. 15 is a perspective view of the ironing board shown in FIG. 1 when in use.

Referring to FIG. 1 there is shown an ironing board 1 which is suitable for domestic use. The ironing board 1 comprises a body 3 made from moulded plastics material and a detachable upper surface 5 comprising a powder coated steel mesh. The body 3 and mesh 5 together define a chamber. A cover of porous textile material is fitted over the mesh and held in place, to provide an ironing surface of conventional shape.

When in a deployed configuration (shown in FIG. 1), the ironing board 1 is arranged such that the ironing surface 5 is substantially horizontal. Extending from one end of the body 3 is an iron rest 7 made from moulded plastics material and having a protective metal layer fixed to its upper surface. Attached to the same end of the body 3 such that it is in fluid communication with the body interior is a mains electricity operated fan unit 8 which is capable of sucking fluid from the body interior or blowing fluid into the body interior. The opposite end of the body 3 is tapered to form a nose 10 which serves as a convenient ironing region for garments.

Figure 3:
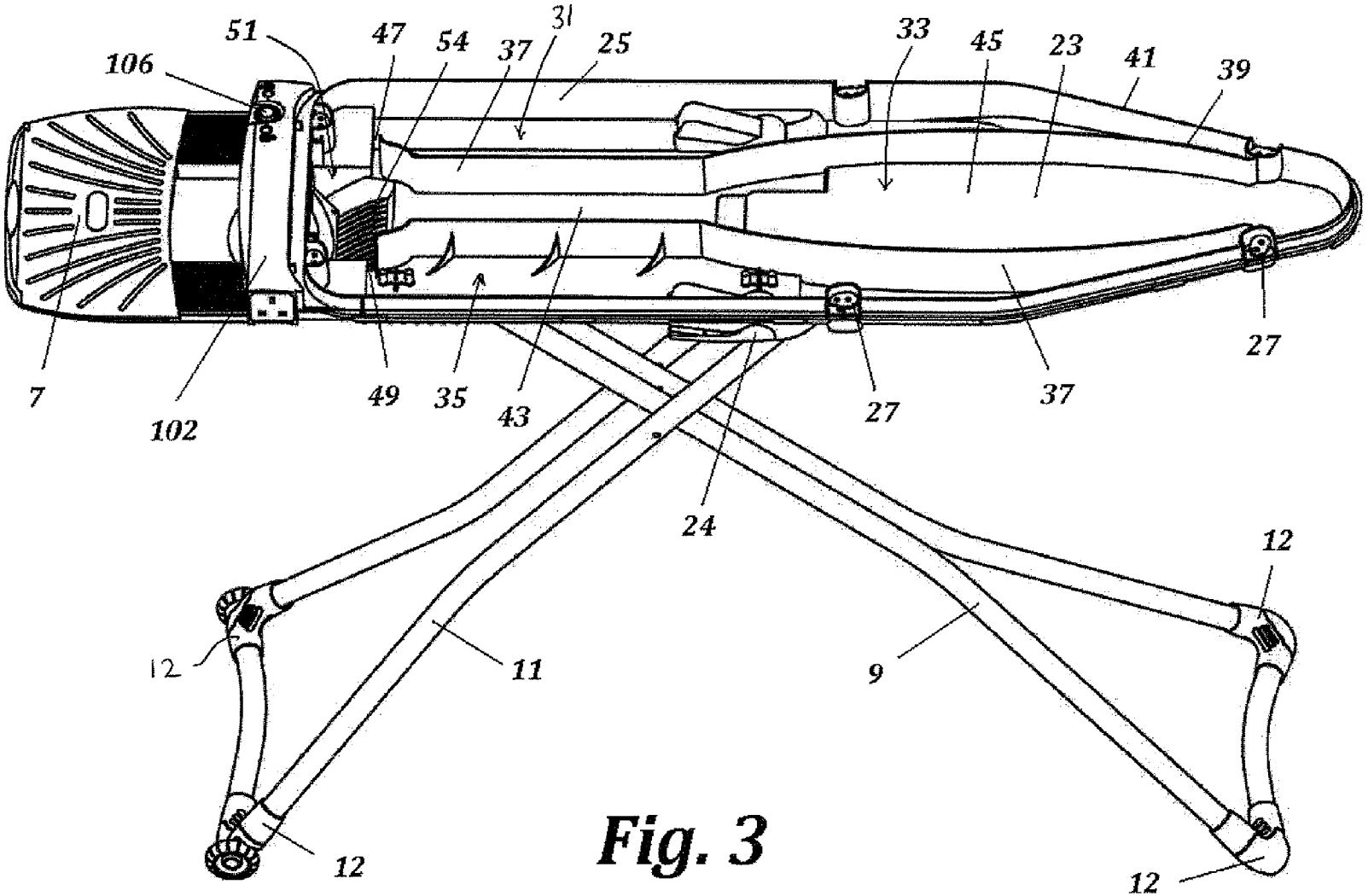
FIG. 3 is a perspective view of the ironing board shown in FIG. 1 when the upper surface of the board has been removed.

Referring to FIG. 3, the mesh 5 of the chamber is detachable from the body 3. The body comprises a lower surface 23 and a continuous wall 25 which extends substantially vertically up from the lower surface 23 along its perimeter. Six locking devices 27 (which will be described in more detail below) are arranged around the perimeter of the body 3 and are recessed within the body wall 25.

The body 3 is divided into three substantially separate regions 31, 33, 35 by two internal dividing walls 37 which extend substantially vertically up from the lower surface 23 of the body 3 such that the free edge 39 of each wall 37 lies substantially within the same plane as the free edge 41 of the body wall 25. Thus, when the mesh 5 is attached to the body 3, the free edge 39, 41 of each wall 37, 25 is substantially flush with the underside of the mesh 5 and the three regions 31, 33, 35 are substantially separate from one another.

The central region 33 is defined by the two internal walls 37 and the nose end of the body wall 25. The two internal walls 37 extend approximately 40 cm from the fan unit end of the body 3 along the body interior and are arranged to be substantially parallel to one another such that they form a narrow channel 43. The narrow channel 43 is approximately 10 cm across and either side is spaced apart from the body wall 25 by approximately 12 cm. Toward the nose end of the body 3, the two walls 37 curve away from each other toward the body wall 25, then back towards each other and terminate at the nose end of the body wall 25. Thus, a bulbous section 45 of the central region 33 is defined at the nose end of the body 3 when the mesh 5 is attached. The outer regions 31, 35 are defined by the internal walls 37, the body wall 25 and the mesh 5 to form two narrow channels either side of the central region 33.

At the fan unit end of the body 3, the internal walls 37 curve outwardly toward the body wall 25 but terminate before coming into contact with the body wall 25 so as to define two openings 47, 49 at the fan unit end of each side region 31, 35. Each of the regions 31, 33, 35 therefore merges to form a common region of space 51 within the body 3 adjacent to the fan unit 8. Thus, the fan unit 8 is in fluid communication with each separate region of the body 3 via each opening. The openings 47, 49 of the side regions 31, 35 are lower in cross-sectional area than the opening of the central region 33. Therefore, a higher proportion of air and steam is driven into or out from the central region 33 of the body 3 than the side regions 31, 35.

Figure 4:
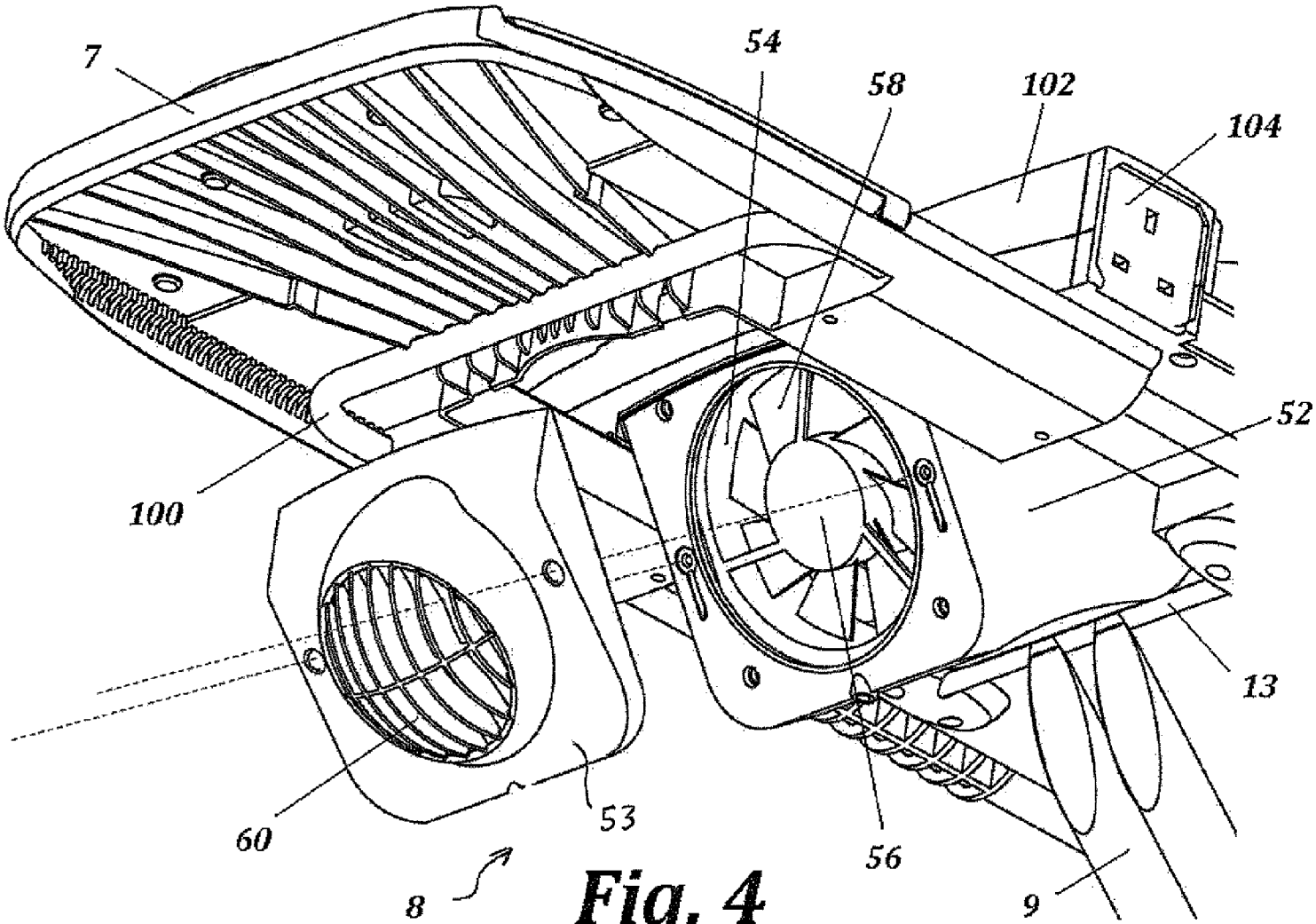
FIG. 4 is an enlarged, partially exploded view of a fan unit attachment shown in FIG. 2.

Referring to FIG. 4, the fan unit 8 comprises a body 52 through which is defined a substantially cylindrical port 54 which extends from one side of the body 52 through to the other side. Disposed within the port 54 is a fan 56 operative so that steam laden air can be sucked out from the ironing board body 3 or air blown into the body 3. The fan unit 8 further comprises a cover 53 having a hemispherical grill 60 which provides an opening through which steam laden air can be expelled or air drawn in by the fan and additionally restricts access to the fan 56 to minimise the likelihood of injury caused by the fan when in use. The cover 53 may be fixed to the body 52 of the fan unit 8 with screws through complimentary holes in either part. The fan unit 8 is connected at the base of the body 3 and is arranged so that the fan 56 and grill 60 together direct steam laden air away and back from the body 3 in order to reduce the effects of condensation on the underside of the mesh 5. As can be seen from FIG. 3, the common region 51 of the body 3 has a sloped section 54 which is inclined toward the fan unit 8 so that any condensation formed within the body 3 is directed away from the regions 31, 33, 35 of the body 3.

The use of a detachable cover 53 permits other devices to be connected to the back of the fan unit 8. Thus, complimentary equipment such as a duct enabling steam laden air to be directed outside a room where the ironing board is used or a condensing unit (not shown) to condense steam out of exhaust from the fan unit can optionally be used in conjunction with the fan unit 8.

Figure 2:
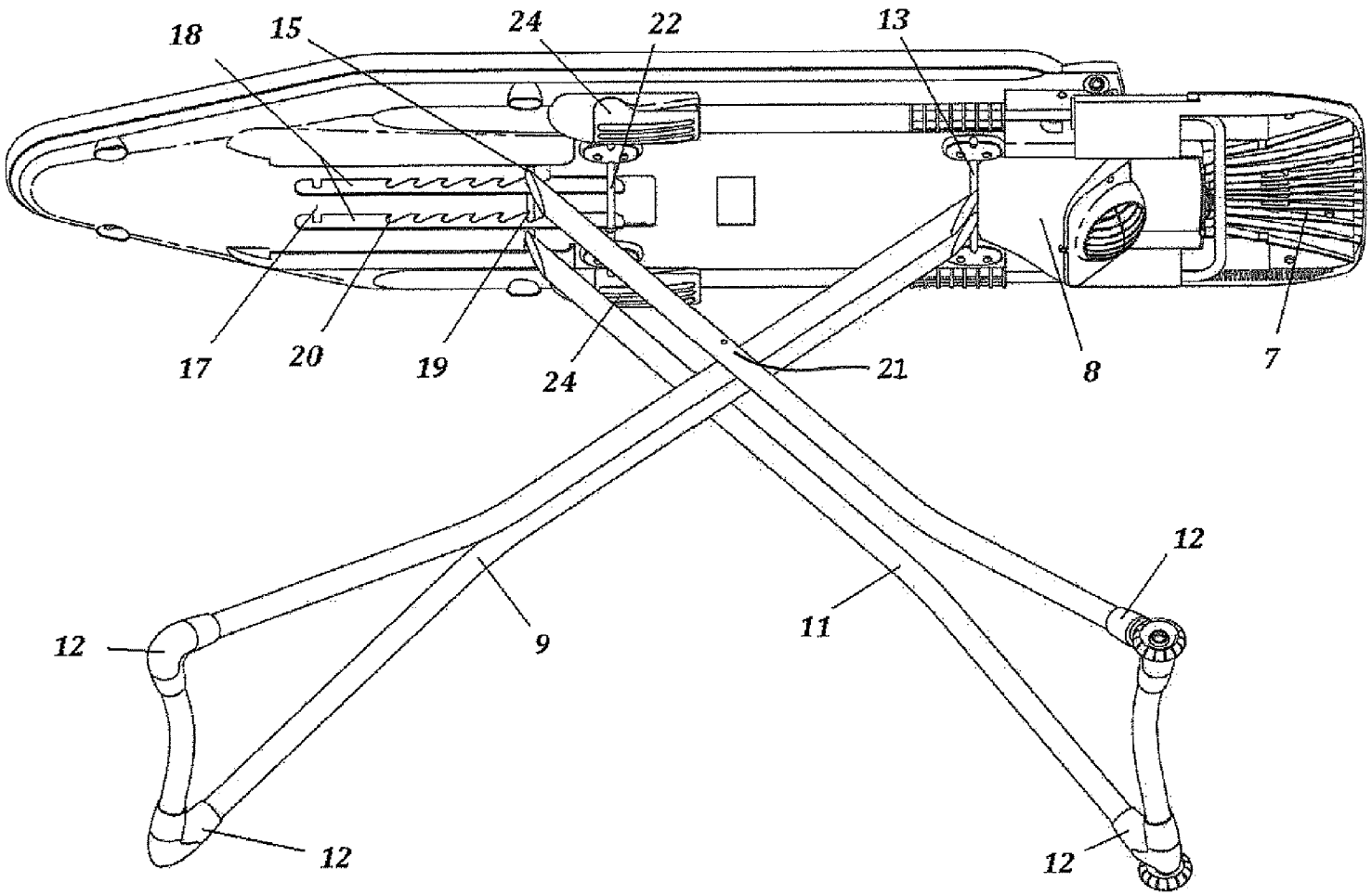
FIG. 2 is an underside perspective view of the ironing board shown in FIG. 1.

Referring to FIG. 2, a pair of powder coated steel legs 9, 11 is attached to the underside of the body 3 to provide a support for the ironing board 1 when in the deployed position so that the ironing surface 5 can be maintained in a substantially horizontal arrangement at a comfortable ironing height for a user. Each leg comprises two lengths that are welded at one end to a metal rod and connected at the other end by an appropriately sized metal length via two approximately L-shaped brackets 12. A wheel is connected to each L-shaped bracket of the second leg 11 to improve the manoeuvrability of the ironing board whether in a deployed or a storage configuration.

One leg 9 is pivotally attached toward one end of the body 3 via its metal rod which acts as a pivot point 13. The first leg's 9 pivot point 13 is fixed relative to the body 3. The other leg 11 is pivotally attached toward the other end of the body 3 via its metal rod which also acts as a pivot point 15 but its pivot point 15 is arranged to slide relative to the body between a first position 17 and a second position 19. The first position 17 is toward the nose 10 of the body 3 and the second position 19 is toward the centre region of the body 3 toward the pivot point 15 of the first leg 9. The two legs are pivotally connected together at a point 21 about one third the way down either leg 9, 11 from the underside of the body 3. Thus, when the second leg 11 is moved from the first position 17 to the second position 19, the pivot point 21 of the two legs forces them to extend out from the body 3 into a deployed position. Returning the second leg 11 to the first position 17 collapses the legs 9, 11 towards the underside of the body 3 thus placing the ironing board 1 in a storage configuration (shown in FIG. 11).

Figure 5:
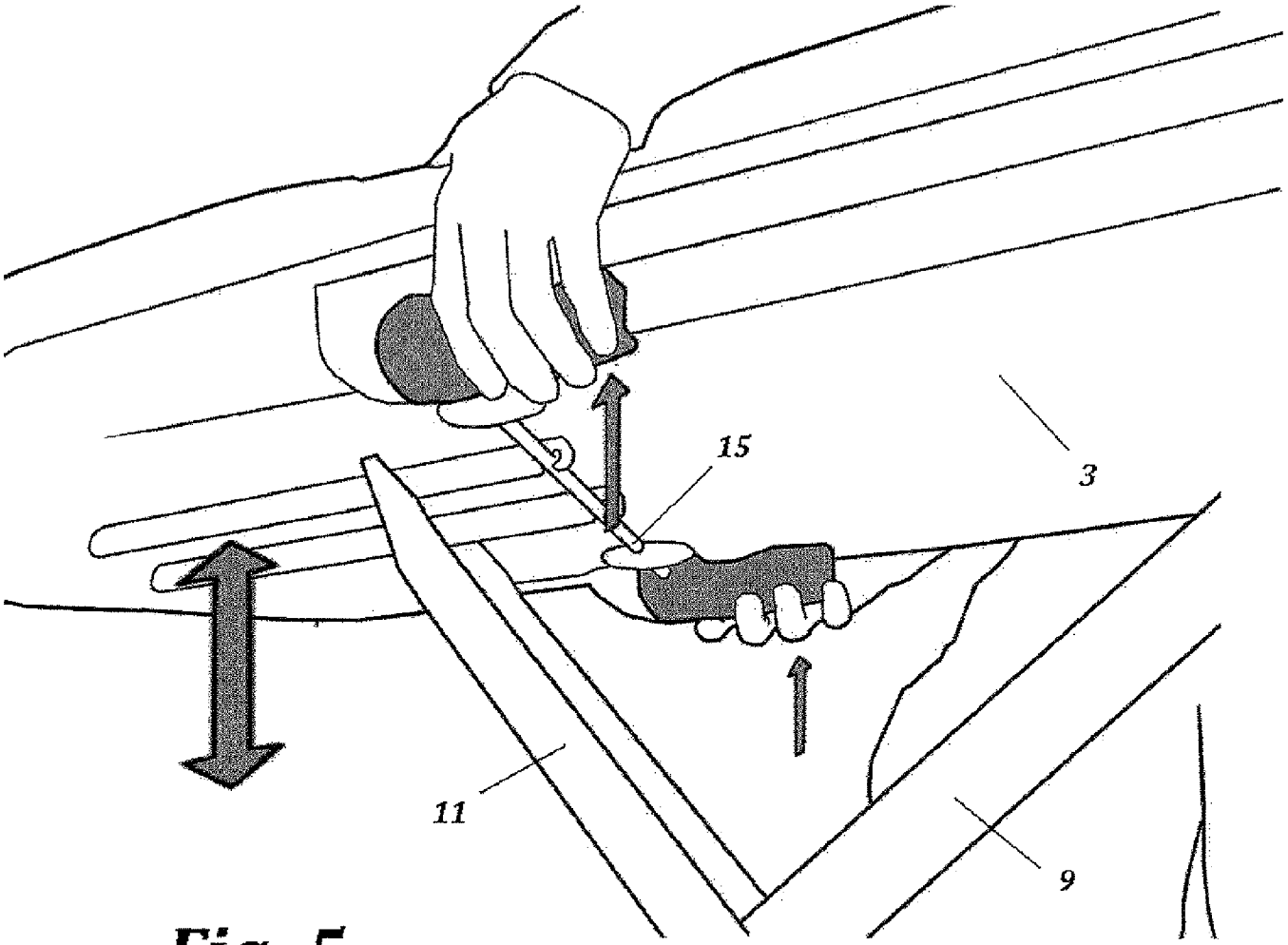
FIG. 5 is an enlarged, underside perspective view of a height adjustment mechanism of the ironing board shown in FIG. 1.

The pivot point 15 of the second leg 11 is fixed relative to the body 3 by a locking means 18 which comprises two substantially parallel metal strips each having a plurality of locking points 20 provided along their respective lengths. As depicted in FIG. 5, each metal strip is fixed at one end to a metal rod 22 which is in turn fixed to a pair of levers 24 that are attached to the underside of the body 3. Depressing the levers 24 causes the metal rod 22 to rotate which in turn causes the metal strips to pivot away from the underside of the body 3. The metal strips are additionally connected to the metal rod 22 by a pair of springs (not shown) which serve to return the strips to the underside of the body 3 when the levers 24 are released.

Movement of the metal strips away from the body 3 releases the pivot point 15 of the second leg 11 and permits it to slide along the underside of the body 3. The pivot point 15 can be held in place by common locking points 20 of the metal strips. Each locking point 20 corresponds to a different height of the mesh 5 above the ground and therefore provides the user with means for easily adjusting the height of the mesh 5. The closer the pivot point 15 of the second leg 11 is to that of the first leg 9, the higher the mesh 5 is above the ground. The locking point furthest removed from the pivot point of the first leg 9 corresponds to the first position 17 of the pivot point 15 of the second leg 11.

Figure 6:
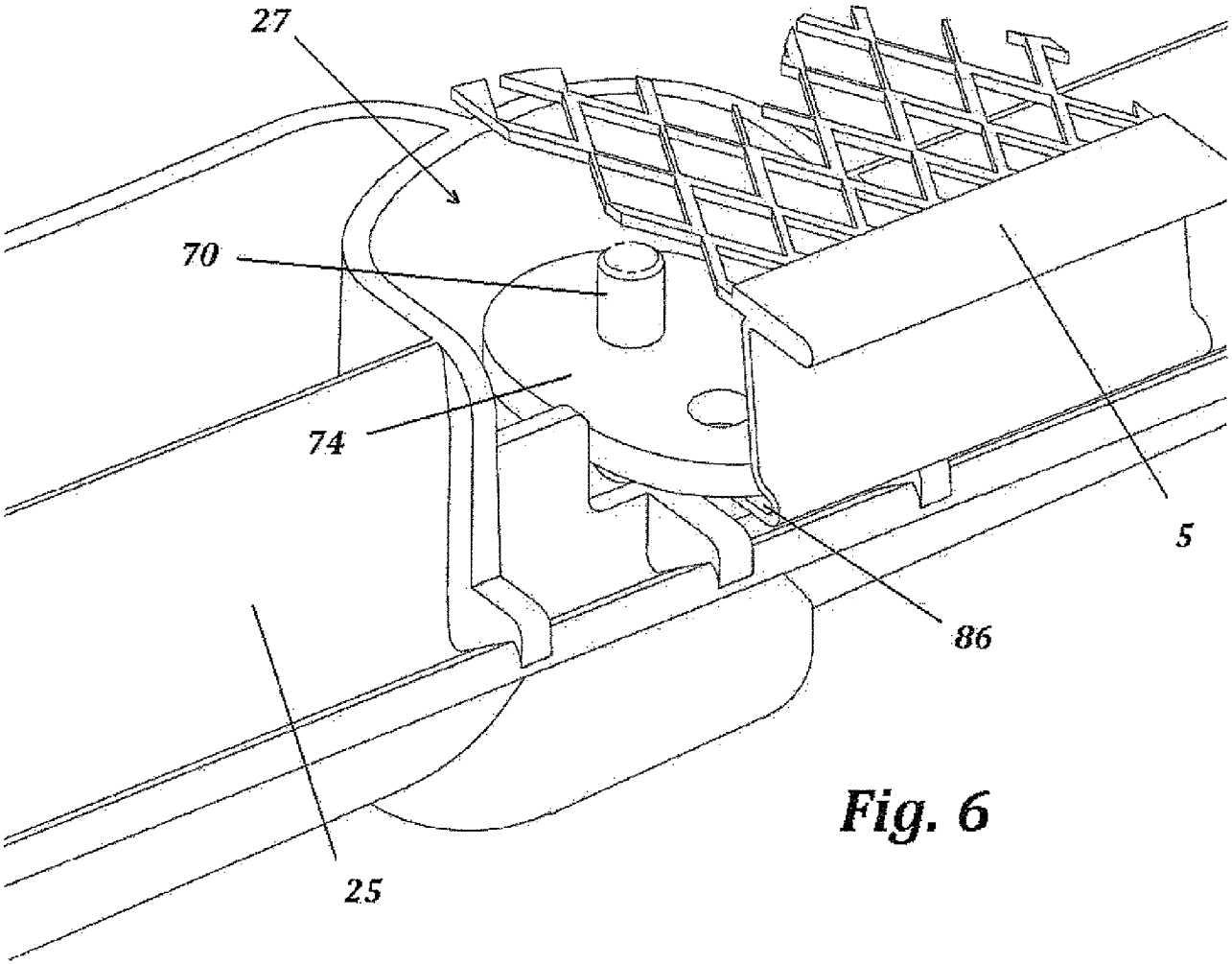
FIG. 6 is an enlarged, perspective view of a cam locking device of the ironing board shown in FIG. 3.
Figure 7:
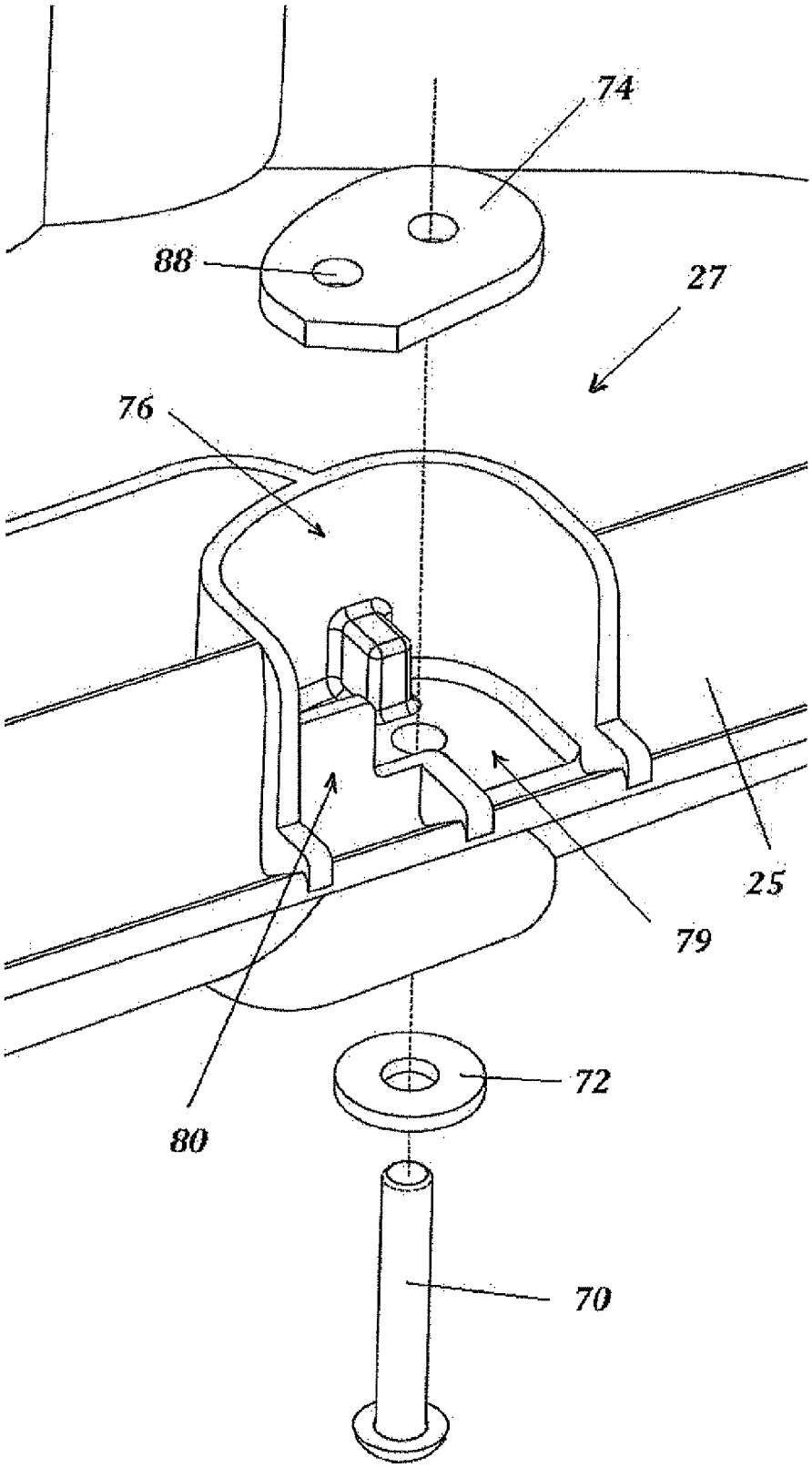
FIG. 7 is an exploded view of the locking device shown in FIG. 6 when the upper surface of the board has been removed.

Referring to FIG. 6, the locking device 27 is used to retain the mesh 5 of the body 3 in place on the ironing board 1. As can be seen more clearly in FIG. 7, the locking device comprises a threaded screw 70, a washer 72 and a cam 74. The screw 70 is threaded through the washer 72 beneath the body 3, through a screw hole in the base of the recess 76 and subsequently through a corresponding hole in the cam 74.

Figure 8:
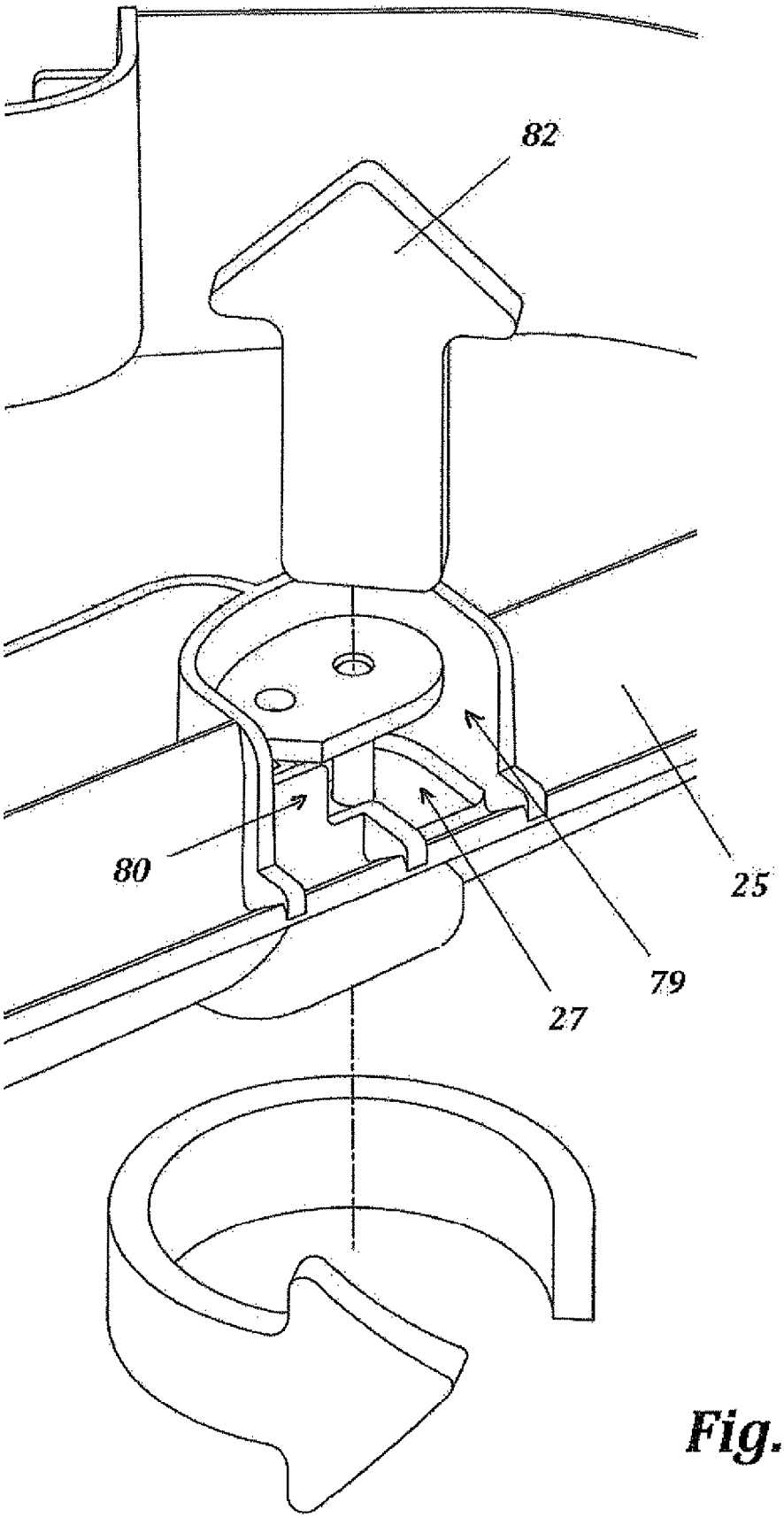
FIG. 8 is a perspective view of the locking device shown in FIG. 6 when in an assembled configuration and in use.
Figure 9:
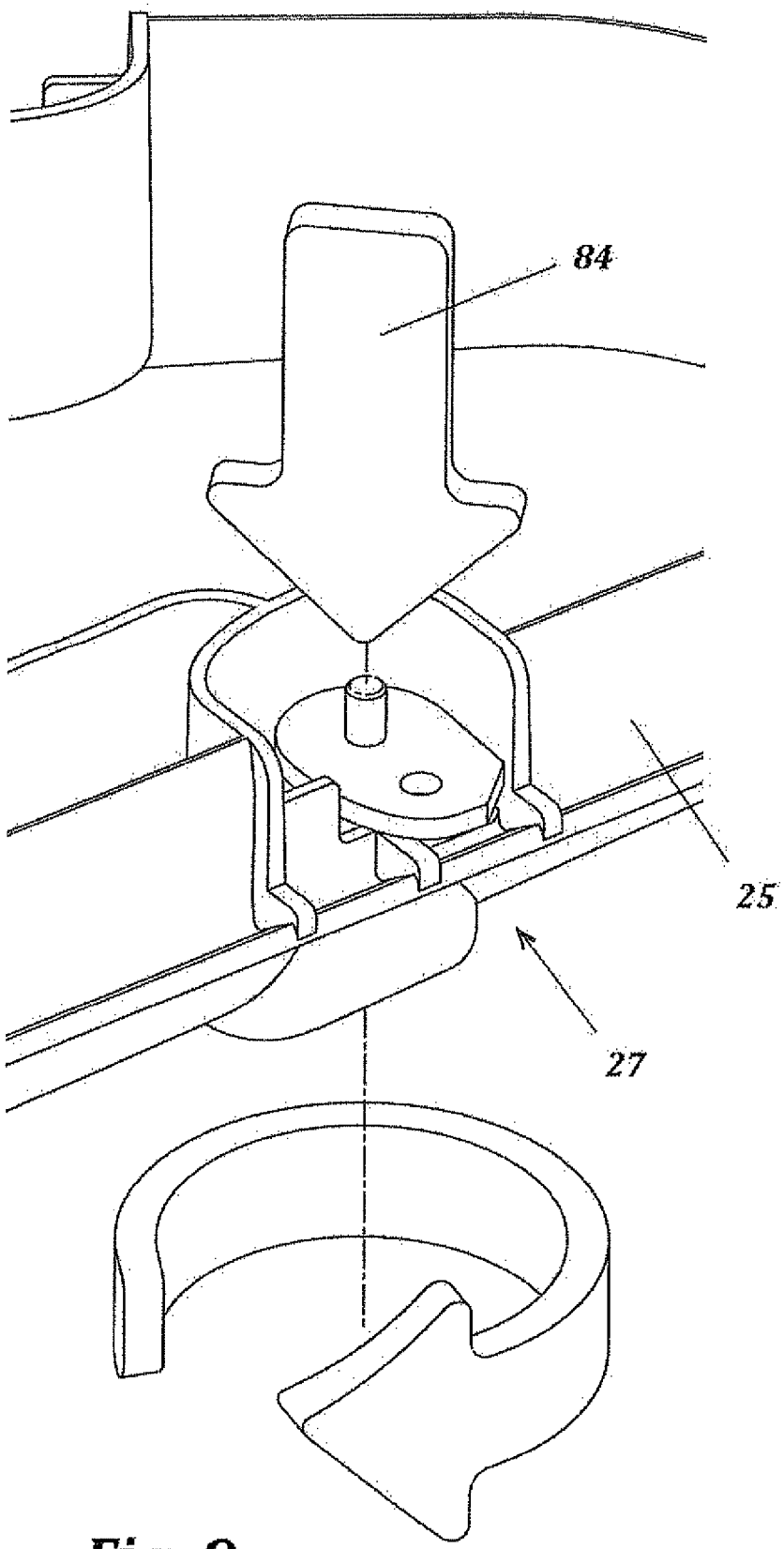
FIG. 9 is an alternative view of the locking device shown in FIG. 8 when in use.

Referring to FIG. 8, in order to affix the mesh 5 to the body 3 to retain it in place, the locking device 27 is first assembled such that the cam 74 is within the recess 76. When seated within the recess 76, the cam 74 is restricted from exiting the recess via a lower opening 79 by an abutment 80. This is because the cam 74, which can only be fully seated within the recess 76 lengthways, is longer than the opening 79 is wide. The screw 70 is threaded into the cam 74 until the top of the screw 70 just extends through the hole of the cam. Thus, by fully inserting the screw 70 through the hole in the base of the recess 76, the cam 74 is forced in an upward direction as indicated by directional arrow 82 to the extent that it is able to clear the abutment 80. In this position, as shown in FIG. 9, the screw and cam combination can be rotated so that the cam 74 extends outwardly from the recess and can be seated within the lower opening 79 whose width is greater than that of the cam 74. When seated within the opening 79, the screw can be rotated further into the cam 74 which has the effect of drawing the cam 74 toward the base of the recess 76 as indicated by directional arrow 84.

Referring once more to FIG. 6, the mesh 5 comprises a U-shaped groove 86 which extends around its entire lower perimeter and which provides a recess into which the cam 74 can be seated to lock the mesh 5 in place. When affixing the mesh 5 to the body 3, each of the locking devices 27 is arranged so that the cam 74 is seated lengthways within its respective recess 76 and the screw is threaded through the hole of the cam so that it just extends through the cam. The mesh 5 is then placed upon the free edge 39, 41 of the body wall 25 and internal walls 37 and each respective locking device 27 is rotated so that the cam 74 clears the abutment 80 of each respective recess 76 and becomes seated within the groove 86 of the mesh 5.

A hole 88 is provided in each cam 74 to allow a user to pass an Allen key or screwdriver through an opening in the mesh 5 and into the hole 88 so as to assist the rotation of the cam 74 into the groove 86. As can be seen from FIGS. 7 to 9, a corner of the cam 74 is removed so that, when the cam is rotated into the groove 86, it does not abut the innermost wall of the groove 86 and prevent the cam 74 from being fully rotated into position. The screw 70 of each locking device 27 is then rotated and tightened which forces the cam 74 and, hence, the mesh 5 toward the body 3. When each of the screws 70 is fully threaded through a respective cam 74, the mesh 5 is held firmly in place.

Referring to FIGS. 4, 13*a* and 13*b*, the iron rest 7 can be extended out from the end of the body 3 in order to accommodate irons of different sizes. The iron rest 7 is connected to the body 3 by a cylindrical metal pole 100 which is bent at two points to form a U-shape. The two ends of the U-shaped pole, which are of equal length, extend into correspondingly sized cylindrical channels in the body 3 of the ironing board 1. The remaining side of the U-shaped pole extends across the width of the iron rest 7 to provide a solid base. The channels support the iron rest 7 and enable it to slide along the channels in a telescoping fashion. An abutment prevents the ends of the U-shaped pole, and hence the iron rest, from extending beyond the channels so that the iron rest 7 is always supported by the body 3 of the ironing board 1, thereby enabling the iron rest to adequately support an iron even when in an extended position.

Figure 10:
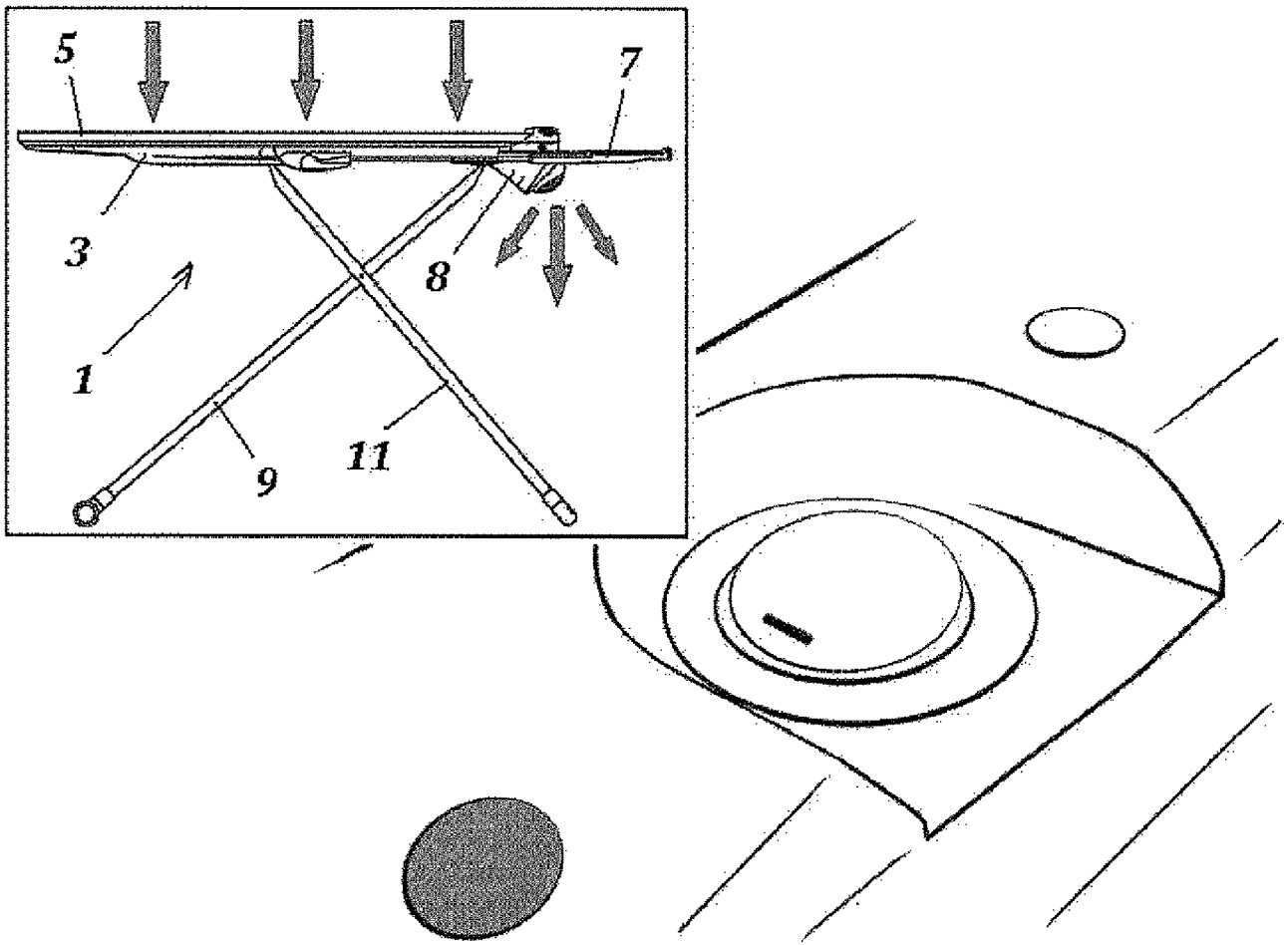
FIG. 10 is a side view of the ironing board shown in FIG. 1 when in a suction mode of operation.
Figure 11:
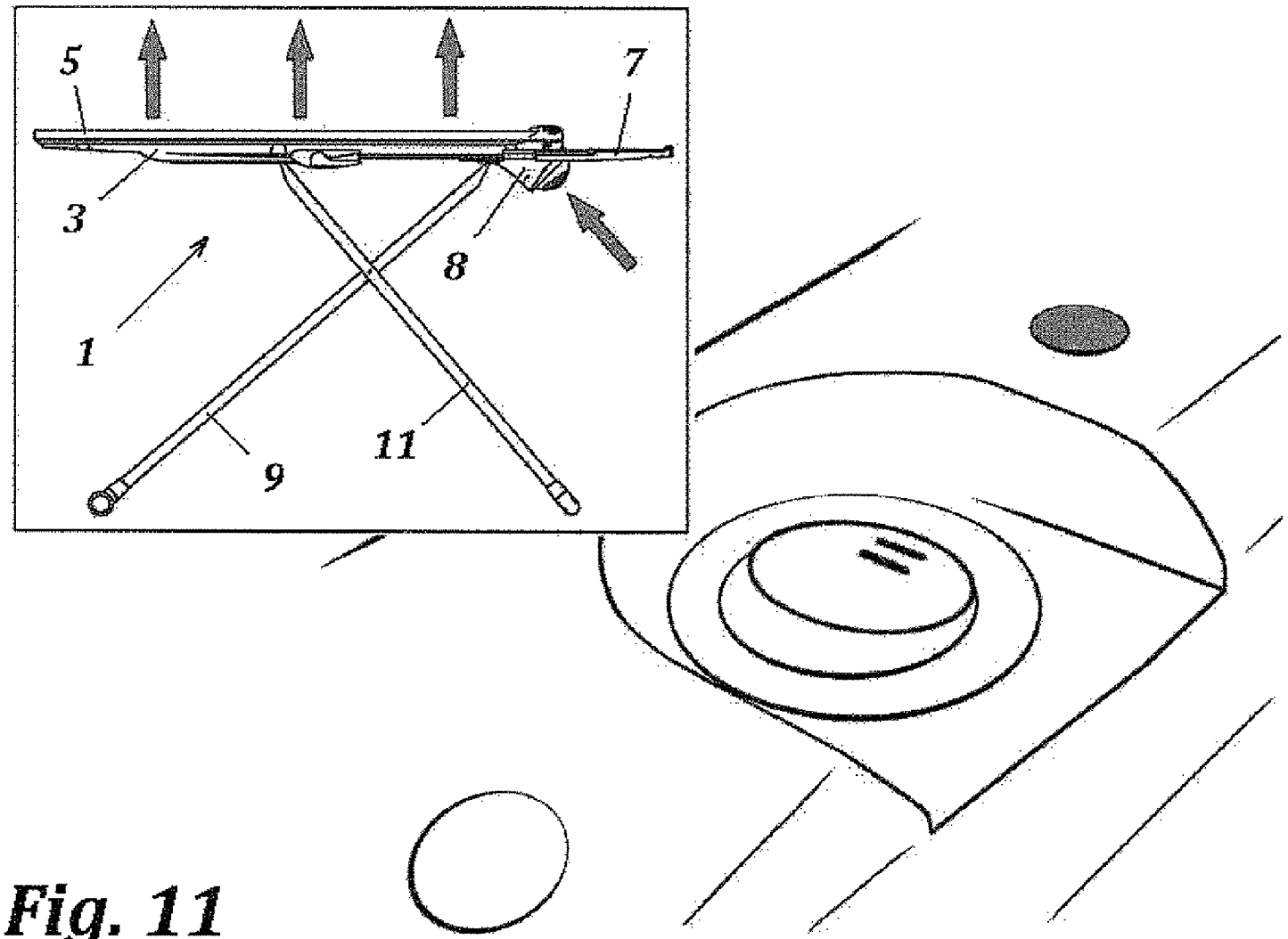
FIG. 11 is a side view of the ironing board shown in FIG. 1 when in a blowing mode of operation.
Figure 12:
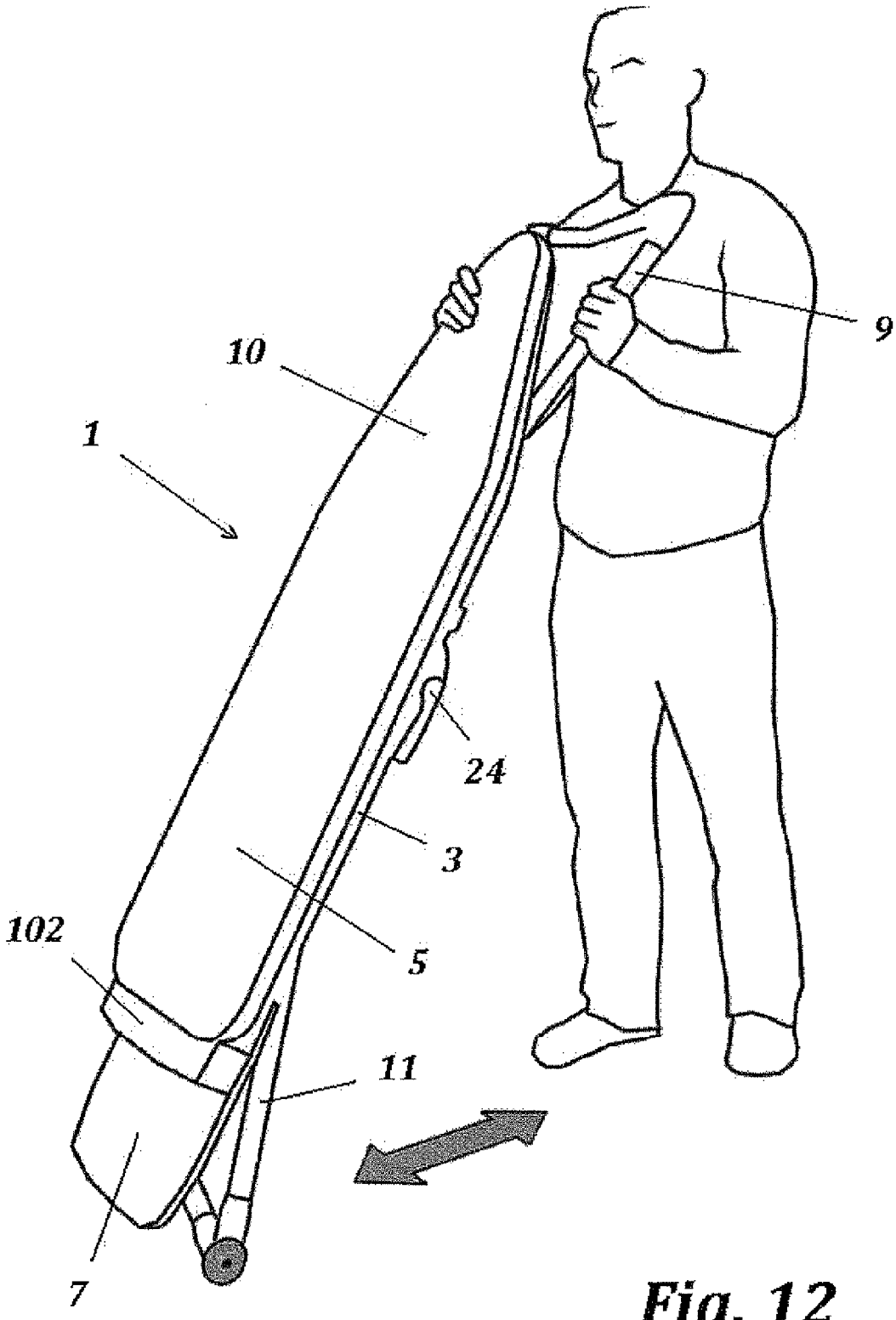
FIG. 12 is a perspective view of a user moving the ironing board shown in FIG. 1 when in a storage configuration.

A compartment 102 is attached to the top of the body 3 and comprises a plug socket 104, a power lead (not shown) and various electronic components of the fan unit 8 which control its operation. The plug socket 104 provides a conveniently located socket for the plug of an iron thereby extending the overall reach of the iron for the user. When the compartment 102 is plugged into the mains supply, the internal electronic components provide power for the fan which can be operated via a switch 106 provided on the top of the compartment 102. The switch 106 has three positions which correspond to "off", "reverse fan flow" and "forward fan flow". The fan unit 8 can therefore be conveniently and easily activated or deactivated and turned from a suction mode to a blowing mode or vice versa, as depicted in FIGS. 10 and 11.

When in use, a user deploys the ironing board 1 and adjusts the position of the pivot points 13, 15 relative to one another until the ironing surface 5 is at the desired height above the ground. Once plugged in, the user has the option of using the suction mode or the blowing mode and activates the switch 106 accordingly. Typically, when ironing garments using a steam iron, the suction mode is desirable. When in the suction mode, the fan 56 causes a drop in pressure in the body interior and thus a pressure gradient is created across the mesh 5. This pressure gradient gives rise to a flow of air and steam through the ironing board cover and mesh 5 into, and subsequently out of, the chamber via the fan 56 and exhaust grill 60 as shown in FIG. 10.

When in suction mode, the air and steam flows through each region 31, 33, 35 of the body 3. The shape and dimensions of the central region 33 gives rise to an increase in the rate of fluid flow through the mesh of the central region 33. This increased rate of fluid flow sucks the ironing board cover toward the mesh 5 and provides an adequately flat ironing surface in the nose region of the board as shown in FIG. 15. It additionally draws steam from the iron through the garment more evenly and quickly than conventional fan assisted ironing boards which reduces ironing time and improves the finish. This is in contrast to conventional fan assisted ironing boards with fans of similar capacity which suffer from inadequate rates of fluid flow through this region of the board.

When it is desirable to blow air or steam laden air out from the body interior via the mesh 5, the switch is activated accordingly and the direction of rotation of the fan 56 is reversed. This reverses the pressure gradient across the mesh 5 and causes air to blow out from the body interior as shown in FIG. 11. Such functionality is useful when it is desirable to aerate the ironing board cover or a garment or other item placed thereon.

It is of course to be understood that the above embodiments have been described by way of example only and that many variations are possible without departing from the scope of the invention.

The invention claimed is:

1. An ironing board comprising a permeable ironing surface mounted on a body, the body comprising one or more ports through which fluid may be driven to cause the fluid to flow through the permeable ironing surface, said body further comprising a means for modifying the flow of fluid through selected regions of the surface, wherein the body and the permeable ironing surface together define a hollow chamber beneath the permeable surface, wherein the means for modifying the fluid flow rate through the permeable surface comprises one or more walls dividing the hollow chamber into two or more regions, wherein there are two walls dividing the body into three regions, and one of the regions separates the other two along the center of the body to form a central region and two side regions, wherein the central region comprises two sections, one of the sections having a larger cross-sectional area and the other section having smaller cross-sectional area; and one or more means for driving fluid through one or more ports, wherein the larger section is further from the or each driving means than the smaller section.

2. An ironing board as claimed in claim 1, wherein the permeable surface comprises holes and specific regions of the surface have holes of a larger cross-sectional area than other regions of the surface.

3. An ironing board as claimed in claim 1, wherein the walls of each region restrict fluid flow from one region to another.

4. An ironing board as claimed in claim 1, wherein one or more driving means is a fan.

5. An ironing board as claimed in claim 4, wherein the or each fan is connected to the body of the ironing board.

6. An ironing board as claimed in claim 1, wherein the body has an open region and the permeable surface is shaped and configured to cover the opening.

7. An ironing board as claimed in claim 1, wherein the permeable surface is detachable from the body.

8. An ironing board as claimed in claim 1, wherein the central region has a larger cross-sectional area than either side region.

9. An ironing board as claimed in claim 1, wherein the larger section and the smaller section are arranged relative to the driving means such that the smaller section is between the driving means and the larger section.

10. An ironing board as claimed in claim 1, wherein the regions define a fluid flow path from the permeable surface to the or each port.

11. An ironing board as claimed claim 1, further comprising an iron rest which extends from an end of the body and which can be moved from a first position to a second position, wherein the second position is further from the body than the first position.

12. An ironing board comprising a permeable ironing surface mounted on a body, the body and the permeable ironing surface together define a hollow chamber beneath the permeable surface, said body comprising one or more ports through which fluid may be driven to cause said fluid to flow through said permeable ironing surface, said body further comprising a means for modifying the flow of fluid through selected regions of the surface, said means for modifying the fluid flow rate through the permeable surface comprising two walls dividing the body into three regions, one of the regions separating the other two along the center of the body to form a central region and two side regions, said central region comprising two sections, one of the sections having a larger cross-sectional area and the other section having smaller cross-sectional area, said body being tapered at an end and said larger section of the central region being arranged to be adjacent the tapered end of the permeable surface.

13. An ironing board as claimed in claim 12, wherein the larger section and the smaller section are arranged relative to the driving means such that the smaller section is between the driving means and the larger section.

14. An ironing board comprising a permeable ironing surface mounted on a body, the body and the permeable ironing surface together define a hollow chamber beneath the permeable surface, said body comprising one or more ports through which fluid may be driven to cause said fluid to flow through said permeable ironing surface, said body further comprising a means for modifying the flow of fluid through selected regions of the surface, said means for modifying the fluid flow rate through the permeable surface comprising two walls dividing the body into three regions, one of the regions separating the other two along the center of the body to form a central region and two side regions, said central region comprising two sections, one of the sections having a larger cross-sectional area and the other section having smaller cross-sectional area, said regions defining a fluid flow path from the permeable surface to the or each port wherein the cross-sectional area of the fluid flow path of each region is reduced towards the or each port.

15. An ironing board as claimed in claim 14, wherein the cross-sectional area of the fluid flow path of the central region toward each port is greater than that of either side region.

16. An ironing board comprising a permeable ironing surface mounted on a body, said body comprising, one or more ports through which fluid may be driven to cause said fluid to flow through said permeable ironing surface, means for modifying the flow of fluid through selected regions of the surface, and one or more locking means arranged to retain the permeable surface to the body, wherein the or each locking means comprises a cam which can be arranged relative to the permeable surface to retain the permeable surface relative to the body, and wherein the permeable surface comprises a U-shaped groove arranged to receive an edge of the cam, wherein the cam, and hence, the permeable surface can be retained relative to the body.

* * * * *